United States Patent [19]

Scorzo

[11] 4,091,821

[45] May 30, 1978

[54] SMOKING ARTICLE HAVING AN IGNITION SUPPRESSION DISK

[76] Inventor: Samuel P. Scorzo, 2881 Dahlia Ave., Baldwin, N.Y. 11510

[21] Appl. No.: 738,054

[22] Filed: Nov. 2, 1976

[51] Int. Cl.[2] ..... A24D 1/10

[52] U.S. Cl. ..... 131/4 A; 131/10 R; 131/15 A

[58] Field of Search ..... 131/4 A, 15 A, 10 R

[56] References Cited

U.S. PATENT DOCUMENTS

| | | | |
|---|---|---|---|
| 2,764,513 | 9/1956 | Brothers | 131/4 A |
| 2,937,648 | 5/1960 | Meyer | 131/10 R X |
| 3,062,218 | 11/1962 | Temkovits | 131/10 R |
| 3,167,076 | 1/1965 | Mare | 131/10 R |
| 3,276,453 | 10/1966 | Corley | 131/4 A |
| 3,468,314 | 9/1969 | Palmer | 131/10 R |
| 3,528,432 | 9/1970 | Stossel | 131/4 A |

FOREIGN PATENT DOCUMENTS

| | | | |
|---|---|---|---|
| 1,270,093 | 7/1961 | France | 131/4 A |
| 871,102 | 6/1961 | United Kingdom | 131/10 R |
| 760,772 | 11/1956 | United Kingdom | 131/4 A |

*Primary Examiner*—Robert W. Michell
*Assistant Examiner*—V. Millin

[57] ABSTRACT

A smoking article containing an ignition suppression disk is disclosed. The smoking article comprises a tubular smoking wrapper having tobacco therein extending from about one-half to about two-thirds of the length of the wrapper and terminating at a face against which a disk is placed that suppresses ignition. The disk prevents the smoking article from being consumed beyond one-half to about two-thirds the length thereof. A short fill of tobacco in between the disk and the mouthpiece of the smoking article prevents the consumption of the short fill which generally contains the most harmful smoking by-products in highest concentration since the short fill acts as a filter. A non-tobacco filter may be employed on the mouthpiece end of the smoking article.

5 Claims, 3 Drawing Figures

FIG. 1
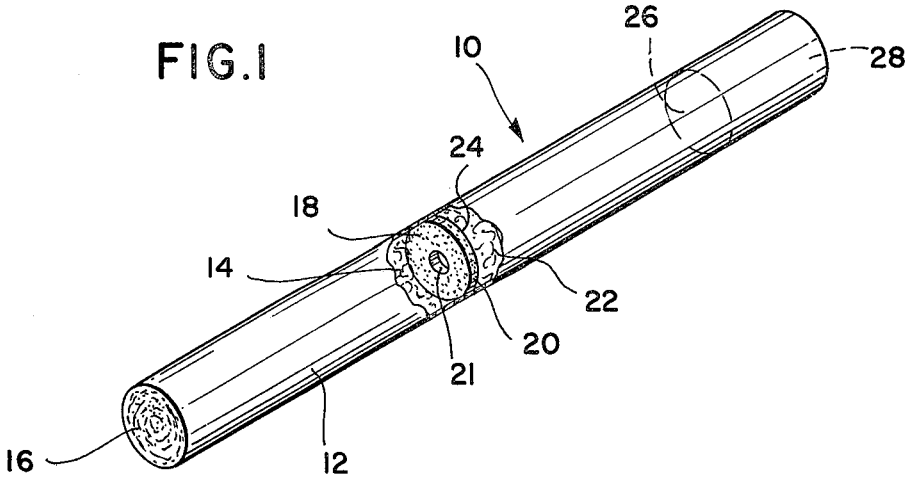
FIG. 2
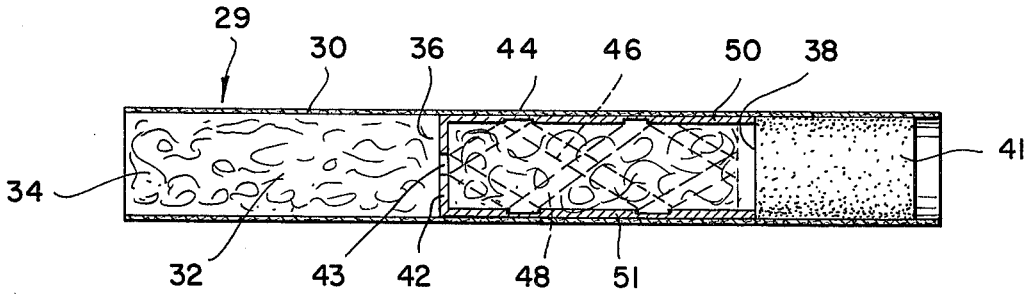
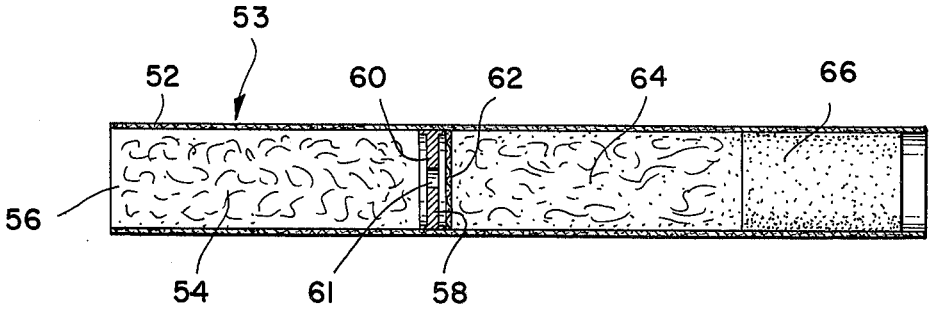
FIG. 3

SMOKING ARTICLE HAVING AN IGNITION SUPPRESSION DISK

SUMMARY OF THE INVENTION

The present invention relates to a smoking article comprising a tubular combustible smoking wrapper having a long fill of tobacco in the wrapper extending inwardly from one end of the wrapper for about one-half to about two-thirds the length thereof. The long fill of tobacco terminates at an inner face within the wrapper. A smoke permeable ignition suppression disk is positioned within the smoking wrapper and abuts the inner face of the long fill of tobacco.

A non-tobacco filter is disposed on said wrapper in a tobacco filtering relationship with the smoking article, the non-tobacco filter being on the end of the wrapper opposite the one end from which the long fill of tobacco extends.

The disk may comprise a paper, metal, ceramic, or non-toxic plastic disk.

A screen may be placed adjacent to the disk and in a preferred embodiment a short fill of tobacco is employed to function as a tobacco filter in between the disk and the non-tobacco filter.

Reinforcing members such as strips or a tube may be provided which extend within the wrapper between the ignition suppression disk and the non-tobacco filter.

The plastic disk may comprise a thermoplastic disk having opening members therein of a sufficient size to allow the passage of smoke therethrough when the smoking article is ignited and to fuse shut when the ignited portion of the smoking article is substantially adjacent the ignition suppression disk.

BRIEF DESCRIPTION OF THE SEVERAL VIEWS OF THE DRAWING

FIG. 1 comprises a perspective view of a smoking article such as a cigarette having an ignition suppression disk located about one-half to about two-thirds the length of the smoking article, the mouthpiece end of the smoking article having a standard cigarette filter thereon according to one embodiment of the invention;

FIG. 2 comprises a side elevation in section of a smoking article having an ingition suppression disk with tobacco positioned inside of a smoking wrapper on either side of the disk, the disk extending from a reinforced tubular member projecting from the mouthpiece end of the cigarette on which a standard cigarette filter is mounted according to another embodiment of the present invention; and FIG. 3 comprises a side elevation section illustrating a smoking article having an ignition suppression disk positioned along the length thereof with smoking tobacco on either side of the disk and a screen positioned in back of the disk, the smoking article terminating in a standard cigarette filter at the mouthpiece end thereof according to another embodiment of the present invention.

DETAILED DESCRIPTION

Filtered smoking articles are disclosed in the prior art U.S. Pat. Nos. Diluzio 3,658,070; Beard 3,631,867; Sherrill 3,628,540; Cameron 3,581,748; Baum, et al., 3,351,072; Curtis, Jr. 3,318,312; Bromberg 3,219,041; and Litchfield, et al., 3,079,926.

Smokers of cigarettes are faced with health problems associated with their smoking habit and for many, it has become an impossibility to give up this habit or to even reduce the amount of smoking that they are ordinarily accustomed to. In the process of changing from one tobacco product to another in order to reduce the intake of harmful tobacco by-products, some smokers have become frustrated in not deriving adequate gratification from smoking and have consequently increased their smoking habits. Manufacturers of smoking articles regularly market new filters and new cigarette lengths which may tend to clean the smoke obtained from the smoking article; however, these so-called mild cigarettes do nothing for smokers who have a habit requiring a few strong puffs to satisfy their craving. For the most part, the so-called mild cigarettes increase the frustration of a heavy smoker even to a greater extent than regular cigarettes and in some cases would have the effect of producing a stronger habit and a heavier reliance on tobacco products.

It is widely accepted that the second half of a cigarette or similar smoking articles such as a cigar, contain a higher concentration of harmful tobacco by-products than the first half of a cigarette, since this portion of the cigarette acts as a filter that traps harmful tars and gasses. Consequently smokers who do not extinguish their cigarettes after they have been consumed about one-half or two-thirds of the length thereof, are generally exposing themselves to a greater risk from these by-products than those smokers who do.

Accordingly, it is an object of the present invention to overcome these and other difficulties encountered in the prior art.

It is a further object of the present invention to provide a smoking article which has an ignition suppression disk located anywhere from one-half to about two-thirds the length of the cigarette or smoking article and in which in one embodiment has a tobacco filter in back of the disk in which the majority of harmful by-products of smoking are trapped.

These and other objects have been achieved according to the present invention and will become apparent by reference to the disclosure and claims that follow as well as the appended drawing.

Referring to the drawing and FIGS. 1–3 therein, a smoking article 10 is illustrated comprising a smoking wrapper 12 having a long or first fill 14 therein, one end of the fill 16 terminating at the ignition end of the smoking article and the other end of the fill 14 terminating at an end anywhere from about one-half to about two-thirds the length of the wrapper 12. An ignition suppression disk 20 is positioned at the end 18 of fill 14, ignition suppression disk 20 having an opening 21 therein which allows the passage of smoke from the tobacco fill 14. A second or short tobacco fill 22 is positioned in back of the disk 20, the fill 22 having an end 24 abutting the disk 20 and an end 26 abutting a standard cellulosic cigarette filter 28.

Referring to FIG. 2 and another embodiment, a cigarette wrapper 30 is provided which has a tobacco fill 32 therein, one end of the fill 32 having an end 34 which terminates at the ignition end of the smoking article and the other end 36 of the fill 32 terminating at an ignition suppression disk 42 having an opening 43 therein. Ignition suppression disk 42 extends by means of stiffening rods 50 and 51 towards the inner face 38 of a conventional cellulosic tobacco filter 41 extending from the mouthpiece end of the wrapper 30. The smoking article 29 has additional reinforcing strips 46 and 48 that crisscross one another along the length of the strips 50 and 52 to provide further stiffening. The smoking article 29 may have a second tobacco fill positioned between the inner face 38 of cellulosic filter 41 and the face of ignition suppression disk 42 pointing in the direction of the filter 41. The chamber defined between face 38 and disk 42 may be completely filled with tobacco or may be emptied of tobacco, although the former embodiment is preferred.

In another embodiment, a smoking article 53 is provided and is illustrated by way of FIG. 3 in which a smoking wrapper 52 has a tobacco fill 54 having an end 56 at the ignition end of smoking article 53 and terminating at an inner end 58 abutting against an ignition suppression disk 60 having an opening 61 therein for the passage of tobacco smoke therethrough as is the case with openings 43 and 21 in disks 42 and 20, respectively. In the embodiment illustrated in FIG. 3, an additional member comprising a screen 62 is positioned in back of disk 60, a chamber being formed between the screen 62 and the filter 66, the latter comprising a standard cellulosic cigarette filter known in the art. The chamber between screen 62 and filter 66 may be filled with a second tobacco fill 64 and may have reinforcing strips extending from screen 62 to the filter element 66 in a manner similar to the arrangement illustrated in FIG. 2 with respect to smoking article 29. The chamber 64 may comprise an empty chamber or may be filled with a second tobacco filler which acts as a filter.

The disks 20, 36 and 60 may be fabricated from paper, metal, ceramic materials such as fired clay or non-toxic plastic materials such as regenerated cellulose fibers compressed into a wad, polyethylene or polypropylene either of the high density or low density type. Low density polyethylene, however, is preferred since there is less residual heavy metal catalyst in this compound as compared to some of the high density polyolefins. The non-toxic thermoplastic materials such as the regenerated cellulose and the polyolefin materials are especially preferred since as the ignited tobacco filler approaches the various disks 20, 42 and 60 these disks when made of the aforementioned materials tend to soften which causes the openings 20, 43 or 61 to flow shut. Where the disk comprises wads of fibrous material the various fibers employed also tend to fuse with one another, the closing of the openings or the fusing of the fibers tending to restrict the amount of tobacco smoke that may be drawn through the disk up to the point where substantially no smoke may be drawn through the disk thereby causing the ignited portion of the tobacco filler to become extinguished.

In use, the chamber in back of the disk, i.e., the chamber formed between the cigarette wrapper, the disk and the standard cigarette filter illustrated in FIGS. 1, 2, and 3 may be empty chambers or may contain a second tobacco fill, the latter embodiment being preferred since this tobacco acts as a filter. Smoking the cigarette in a conventional manner results in the ignited end of the smoking article to approach the disks and upon reaching the disks or the vicinity of the disks, the ignition of the tobacco filler will be suppressed to the point of extinguishing since the disk material has a higher combustion temperature than the temperature of the ignited tobacco.

Although the invention has been described by reference to some embodiments it is not intended that the novel smoking article be limited thereby, but that modifications thereof are intended to be included as falling within the broad spirit and scope of the foregoing disclosure, the following claims and the appended drawing.

What is claimed is:

1. A smoking article comprising a tubular combustible smoking wrapper, a long fill of tobacco in said wrapper extending inwardly from one end of said wrapper from about one-half to about two-thirds the length of said wrapper and terminating at an inner face within said wrapper, a smoke permeable ignition supression disk within said smoking wrapper abutting said inner face of said long fill of tobacco, said disk comprising a low density polyolefin thermoplastic disk having opening means therein, said opening means being of a sufficient size to allow the passage of smoke therethrough when said smoking article is ignited and to fuse shut when the ignited portion of said smoking article is substantially adjacent said ignition suppression disk.

2. The smoking article of claim 1 further comprising a screen placed adjacent to said disk.

3. The smoking article of claim 1 further comprising a short fill of tobacco to function as a tobacco filter, said short fill of tobacco being positioned in back of said disk.

4. The smoking article of claim 1 further comprising reinforcing means extending within said wrapper between said ignition suppression disk and a non-tobacco filter.

5. The smoking article of claim 3 further comprising reinforcing means extending within said wrapper between said ignition suppression disk and a non-tobacco filter.

* * * * *